US005867941A

United States Patent [19]

Gurzenda et al.

[11] Patent Number: 5,867,941

[45] Date of Patent: Feb. 9, 1999

[54] PANIC BAR PROTECTION DEVICE

[76] Inventors: William Gurzenda; Raymond Battaglia, both of 300 Main St., Rockwood, Pa. 15557

[21] Appl. No.: 956,946

[22] Filed: Oct. 23, 1997

Related U.S. Application Data

[60] Provisional application No. 60/029,820, Oct. 25, 1996.

[51] Int. Cl. [6] ..... E05B 1/00

[52] U.S. Cl. ..... 49/460

[58] Field of Search ..... 49/460, 461; 16/111 R, 16/DIG. 1, DIG. 2, DIG. 5; 211/87, 88

[56] References Cited

U.S. PATENT DOCUMENTS 1,090,562 3/1914 Orr ..... 49/460

2,870,493 1/1959 Beyrle ..... 49/460

2,899,718 8/1959 Engels ..... 49/460

4,095,372 6/1978 Rittner ..... 49/460

*Primary Examiner*—Jerry Redman

*Attorney, Agent, or Firm*—Burns, Doane, Swecker & Mathis, L.L.P.; William A. Knoeller

[57] ABSTRACT

A device for protecting door hardware from damage by a wheeled cart being pushed past the door. The device has a generally "T" shaped body with a cross member having its ends bent in a "U" shaped to fit over the hardware to be protected. The long member of the "T" extends at a slant back toward the door surface, there forming an inclined strike plate that a protruding corner of a cart can contact and ride over.

4 Claims, 2 Drawing Sheets

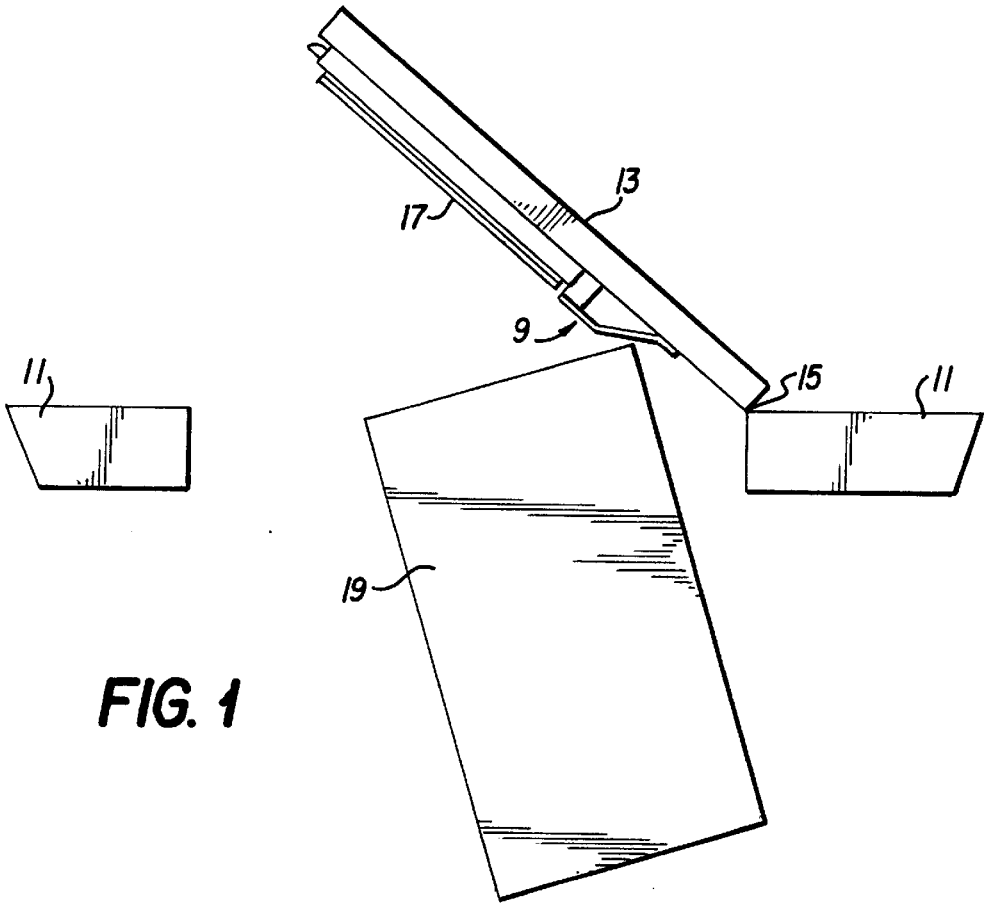
FIG. 1
FIG. 2
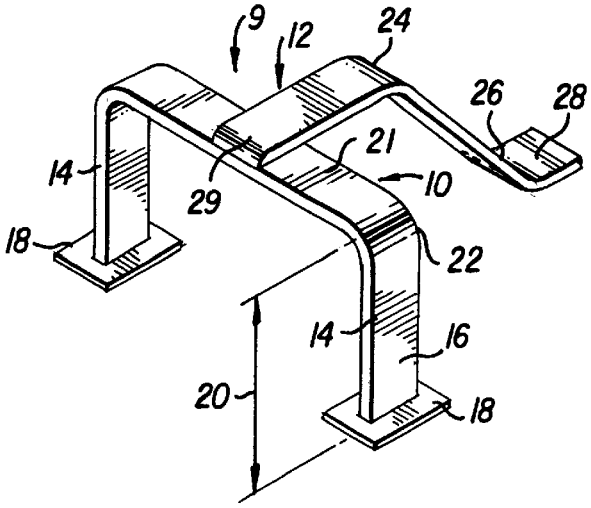

FIG. 3
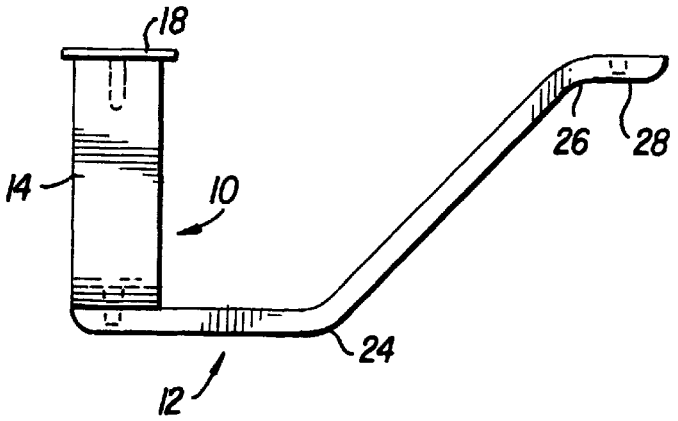
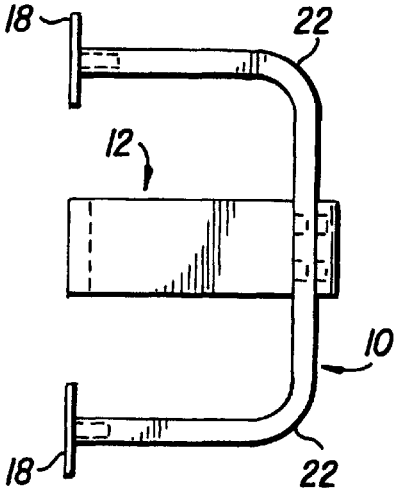
FIG. 4
FIG. 5
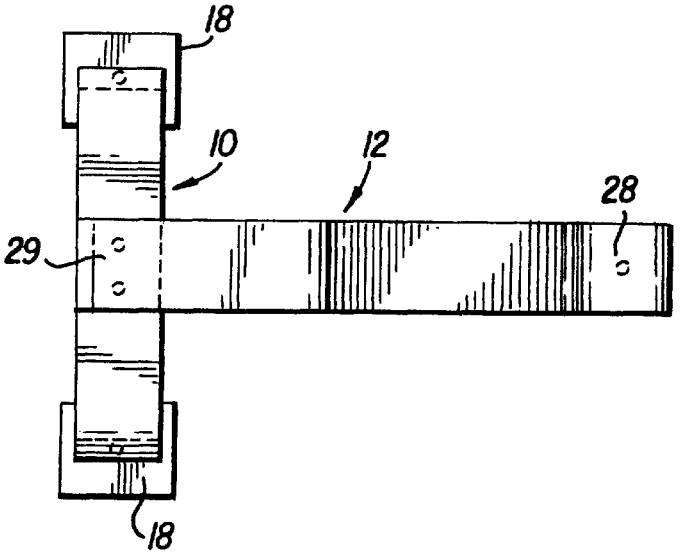

PANIC BAR PROTECTION DEVICE

REFERENCE TO RELATED APPLICATION

Provisional U.S. patent application 60/029,820, filed Oct. 25, 1996 discloses this invention and the priority thereof is hereby claimed.

BACKGROUND OF THE INVENTION

This invention relates to a device for protecting door opening hardware such as door knobs and related devices, in particular those devices commonly called "Panic Bars", from damage by wheeled carts or gurneys which are pushed past doors equipped with such hardware.

A panic bar is usually horizontally mounted on the inner surface of an out-swinging door at a level about three feet above the floor. The panic bar protrudes inwardly from the surface of the door and, at the hinge side of the door, has a protruding edge which is vulnerable to damage by a cart which is being pushed past the door especially when the door is at least partially open when contacted by the wheeled cart.

SUMMARY OF THE INVENTION

The present invention has a generally "T" shaped body and the cross member thereof has its legs bent in a "U" shaped with ends which fit over the end of the panic bar. The ends of the legs of the "U" each having a flange with holes for bolting the flanges to the door. From the center or bight portion of the "U" the longer member of the "T" extends and is preferably a flat bar which extends perpendicularly away from the cross member and then downwardly at an angle toward the door surface. This bar has a hole in its distal end for bolting that end to the door. Thus, the outer surface of the flat bar will, when mounted in place, serve as a strike plate and a protection for the end of the panic bar thereunder so that a cart pushed against the bar will be deflected or slide along the outer surface of the strike plate instead of contacting the end of the panic bar. Thus the end of the panic bar will be protected from damage.

BRIEF DESCRIPTION OF THE DRAWINGS

FIG. 1 is a schematic plan view showing a door with a wheeled cart passing the door and contacting a panic bar protection device of the present invention which is mounted on the door;

FIG. 2 is a perspective of the present invention;

FIG. 3 is a plan view of the device of FIG. 2;

FIG. 4 is a left end view of FIG. 3; and

FIG. 5 is a front elevational view of the device of FIG. 3.

DETAILED DESCRIPTION OF A PREFERRED EMBODIMENT

Referring to FIG. 1, there is shown a wall 11 having an outswinging door 13 pivoted to a doorway in the wall on a hinge point 15. The door 13 is equipped with a so called "panic bar" 17 opening device. This bar is a door latch release mechanism extending horizontally across the door, about three feet above the floor. It projects about two to four inches outwardly from the inside surface of the door and is constructed so that an outward push anywhere along the bar will activate the door latch so that the door can be swung outwardly by continuing to push on the bar.

These panic bar devices generally work very satisfactorily and are required for some exit doors in public buildings such as schools and hospitals. In such buildings it is usual to use wheeled carts or gurneys for transporting goods from one area to another. Usually the cart attendant does not carefully open the door by hand, but instead pushes the cart 19 directly against the panic bar to open the door. This procedure can work satisfactorily if the cart 19 contacts the bar 17 at a point spaced away from the hinge end of the bar.

However, because the hinge end of the panic bar projects outwardly from the door surface by the thickness of bar, usually 2 to 4 inches, this end of the bar is exposed and vulnerable to damage by a wheeled cart.

The present invention effectively prevents such damage by providing a strike bar or plate 12 which forms an angled ramp surface for a cart to slide along and prevent contact by the cart against the end of the panic bar.

The present invention 9 has a generally "T" shaped body and the cross member thereof is "U" shaped in a side view (see FIG. 4). This "U" shaped portion 10 has a width and height sufficient to span over the panic bar. The "U" shaped portion has legs 14 which in use are positioned so that one leg is above a horizontally extending panic bar and the other leg is below the bar.

As can be seen in FIG. 2, the end 16 of each leg 17 is secured to a mounting plate 18 for mounting the device to the inner surface of the door. Alternatively the ends 16 can be turned outward to form a mounting surface in lieu of the mounting plates 18. The legs 14 are joined by a bight portion 21 which is preferably planar between the bent angles 22 which connect it to legs 14. The height 20 of the "U" portion is selected to be slightly greater than the outward projection of the panic bar with which it is used.

The bent angles 22 are bent on as small a radius as can be conveniently done, consistent with the thickness of the material from which the bar is made, preferably ⅜ thick stainless steel rectangular bar stock.

Attached to the central portion of the outer surface of bight 21 is the proximal end 27 of strike plate 12. This strike plate has a planar surface parallel with the outer surface of the bight 21, a downward curve 24 and a complementary return angle 26 bent so distal end 28 of the strike plate lies parallel to the bight outer surface but in the same plane as leg mounting plates 18. Angles 24 and 26 are preferably each 45°, thus when the device 9 is mounted on a door, the "U" shaped portion 10 will surround the panic bar and the central portion of the strike plate 12 will angle down preferably at 45° from a plane parallel to the outer surface of the bight of the "U" shaped portion. The distal end 28 of the strike plate 12 is also secured to the door surface. In installations where there is more room between the end of the panic bar and the hinge side of the door, the invention may be constructed with the angle portion being less than 45°, for example 30°.

It is preferred that the strike plate 12 have its proximal end 29 mounted on the outer surface of the bight 21 so that the edge of a wheeled cart 19 can easily ride up and off the end of the outer surface of strike plate 12. Thus, for the same reason, it is important that angles 22 and 26 be smooth to facilitate easy sliding of the cart edge.

It is contemplated that the present invention could be used to protect inwardly projecting door hardware other than a panic bar, for example (but not limited to) door knobs, door locks, keys, handles, etc. In such cases the "U" shaped portion would not necessarily span over the hardware it protects but instead be spaced horizontally away from the hardware in a direction toward the door hinges so as to permit easier access to the hardware by a user.

We claim:

1. A device for protecting door hardware projecting from a planar surface of a door from damage by objects being moved past said door, said device comprising:

a T shaped body having a long member and a cross member with two legs, said legs being bent so that the cross member is in a U shape with the legs extending toward said door planar surface for securing ends of said legs to said door planar surface with said legs projecting from said door planar surface by a distance at least as great as the projection of the door hardware to be protected;

an elongate bight portion interconnecting said legs, said bight portion having an axis, said bight portion being spaced outwardly from said door planar surface by a length of said legs;

said long member being an elongate strike plate extending generally perpendicular to said bight portion axis, said strike plate having a first portion secured to said bight portion and spaced outwardly from said door planar surface at least as far as said bight portion;

said strike plate having a distal end bent to lie in the plane of said door planar surface and an angled portion on said strike plate between said first portion and said distal end.

2. The device of claim 1 in which said strike plate has two complementary angles at spaced apart positions along its length.

3. The device of claim 1 in which said legs are of equal length and said bight portion has an outer surface lying parallel to said door planar surface.

4. The device of claim 3 in which said strike plate is secured to the outer surface of said bight portion.

* * * * *